United States Patent [19]

Boeve et al.

[11] Patent Number: 4,618,137

[45] Date of Patent: Oct. 21, 1986

[54] SHEET IMAGING APPARATUS

[75] Inventors: Gerard J. Boeve, Edegem; Franciscus Vierveijzer, Mortsel, both of Belgium

[73] Assignee: Agfa-Gevaert N.V., Mortsel, Belgium

[21] Appl. No.: 715,939

[22] Filed: Mar. 25, 1985

[30] Foreign Application Priority Data

Mar. 30, 1984 [EP] European Pat. Off. ..... 84200452.5

[51] Int. Cl.[4] ..... B65H 31/10

[52] U.S. Cl. ..... 271/219; 355/3 SH; 414/54

[58] Field of Search ..... 271/207, 219, 217, 209, 271/213, 214, 224, 186, 65, 902; 355/3 SH; 414/54

[56] References Cited

U.S. PATENT DOCUMENTS 4,220,323 9/1980 Smith ..... 271/213

*Primary Examiner*—Bruce H. Stoner, Jr.
*Assistant Examiner*—John A. Carroll
*Attorney, Agent, or Firm*—William J. Daniel

[57] ABSTRACT

A sheet imaging apparatus with a collector tray for receiving a relatively thick stack of finished sheets. The collecting tray has a stack supporting back plate that is rockably arranged and springloaded, and the upper end of which is upwardly angled with respect to the lower end, whereby sheets in inverted relation may be collected without difficulties.

4 Claims, 3 Drawing Figures

Figure 1:
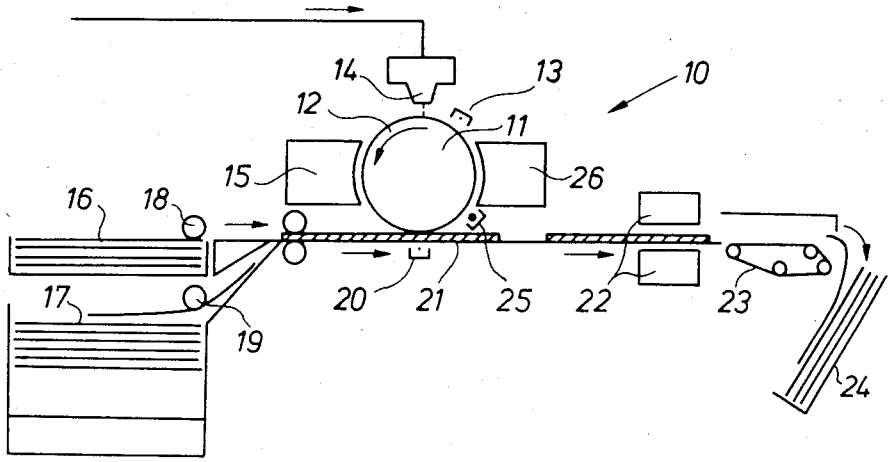
FIG. 1 PRIOR ART

23
43
42
49
44 b
γ'
a
β'
41
24
35
α'
27
36
32
34
40
50
52
37
51
28
38
48
33

SHEET IMAGING APPARATUS

The present invention relates to sheet imaging apparatus wherein sheets are taken in succession from a supply stack of sheets and are submitted to an image-forming treatment, and wherein the sheets are finally collected stackwise in a collecting tray.

Apparatus of the described kind are well known, and include printing presses, copying and printing apparatus, etc. In all these apparatus the sheets are generally discharged from the apparatus in such manner that the surface of the sheet on which the image is recorded faces upwardly as discharged. Consequently, a plurality of sheets collected in a stack in a collecting tray with the recorded surface facing upwardly will be superposed in reverse order relative to the copying or printing sequence as counted from the top of the sheet stack, i.e., in a "last in, first out" order. Accordingly, when different documents are copied or printed in succession, such as the consecutive pages of a book or of an article, it is necessary to reverse the sheet that leaves the imaging apparatus so that its image or obverse side should be turned downwardly so that the next sheet is collected at the rear or reverse side of the foregoing sheet, etc.

Apparatus for collecting sheets in an inverted or overturned relation with respect to their discharge from a copying machine, usually include a guide member disposed proximate the discharge port of the apparatus and inclined at a predetermined angle relative to the direction of sheet discharge from the apparatus, in order to direct the sheet downwardly into a collector tray that is disposed at an acute angle with respect to the vertical plane. The angle at which the leading end of a discharged sheet intersects the plane of the stack of sheets in the collector tray is important, since a small or flat angle allows a smooth sliding of the edge of the discharged sheet frictionally over the top sheet of the stack of collected sheets, although such angle allows but small tolerances on the direction of the path of the delivered sheet towards the stack, whereas a steep angle involves the risk that the leading edge of a delivered sheet does not slide along the stack of collected sheets, but instead becomes blocked or caught on the upper sheet of the stack whereby the delivered sheet forms a buckle and impedes the further operation of the apparatus.

A frequent cause that makes a delivered sheet deviate from its intended path as it leaves the apparatus, is the tendency of the sheet to curl. A common cause for curling is an asymmetric heating of the sheet, for instance by the fusing of a very dense toner image in an electrophotographic copier or printer. An unsatisfactory paper quality is another cause for curling.

Another point that gives rise to difficulties with the proper receipt of a discharged sheet in a collector tray is formed by the size, i.e., thickness, of the stack of collected sheets in the tray. In the case of relatively large or thick stacks, such as stacks comprising 500 sheets or more, the position of the last sheet may be several centimeters higher than the position of the first sheet in the collector tray, and it may be difficult to find a satisfactory direction of approach of the discharged sheets to the stack, in order that a reliable operation be obtained for the first, as well as for the last sheet to be collected.

There are known copying machines with a collector tray that has a pivotable and spring biased stack supporting plate which lowers as the tray fills with sheets so that the height at which the sheets are collected remains approximately constant. An example of suchlike machines is disclosed in IBM Technical Disclosure Bulletin, Vol. 18, no. 7, Dec. 1975, p. 2059–2060. These machines suffer the problem that as a consequence of the changing angle of the stack supporting plate during the filling of the tray, the angle of incidence of a sheet discharged on the growing stack of sheets in the tray changes accordingly, and this may cause difficulties when collecting sheets in overturned relation as mentioned hereinbefore.

It is the object of the present invention to provide a sheet imaging apparatus of the kind referred to that operates reliably, even when thick stacks of sheets are formed in a sheet collecting station wherein the sheets are received in overturned, i.e., inverted, relation.

According to the present invention, a sheet imaging apparatus wherein sheets are taken in succession from a supply stack of such sheets, passed through an imaging station wherein an image is formed on the sheets, wherein then the sheets are directed in inverted relation to form a stock on a collecting tray which has a stack supporting back plate that is disposed at an acute angle with respect to a vertical plane, wherein the first contact of the leading end of a discharged sheet with the stack of sheets in the collector tray, or with the stack supporting plate in the case of the first sheet received in the tray, occurs at an acute angle, and wherein the stack supporting back plate of said collecting tray is pivotably mounted near its lower point and spring biased so that, as the stack builds up in the tray, the back plate lowers and the position of the upper half of the supporting back plate becomes more remote from the sheet discharge point, is characterized in that an upper section of said back plate is upwardly angled with respect to the lower section of the plate so that the sheets received on the plate are more upwardly curved or flexed at their upper portion than at their lower portion, the sheet curvature at the upper end increasing with the number of sheets received in the tray as a consequence of the inclusion of air between the sheets, so that the angle of incidence ($\beta,\gamma,\beta',\gamma'$) of a delivered sheet on the stack of collected sheets remains almost constant during the filling of the tray with sheets.

The desired effect on the angle of incidence in spite of the varying angle of the sheet supporting plate, is a direct consequence of the flexed position of the sheets in the collecting tray, whereby the effect of gravity is less on the upper portion of the sheets than at the lower portion. Air that adheres to the sheet surfaces is consequently urged or squeezed away by gravity to a larger extent at the lower sheet end than at the upper sheet end, and thus the sheets are more tightly stacked at their lower end than at their upper end. The sheets are thus stacked in fanlike fashion and the thickness of a stack may increase in some cases by 50% at the upper end of the stack.

The term "almost constant" indicates in the present specification variations of the angle of incidence that are smaller than 10°, and even preferably smaller than 5 degrees.

The apparatus according to the invention is particularly suited for the collecting of large, i.e., thick, stacks of sheets. As large sheet stacks are considered in the present specification stacks comprising 500 sheets or more, as mentioned already. The apparatus is however also suited for collecting smaller, i.e. thinner, stacks of sheets.

In one suitable embodiment of the apparatus according to the invention, the sheet supporting back plate has flat sections together define a generally curved profile. Suchlike type of plate may be cheaper to manufacture than a continuously curved plate.

The supporting back plate may also be arranged for taking different vertical positions, thereby to accomodate different sheet formats.

Figure 2:
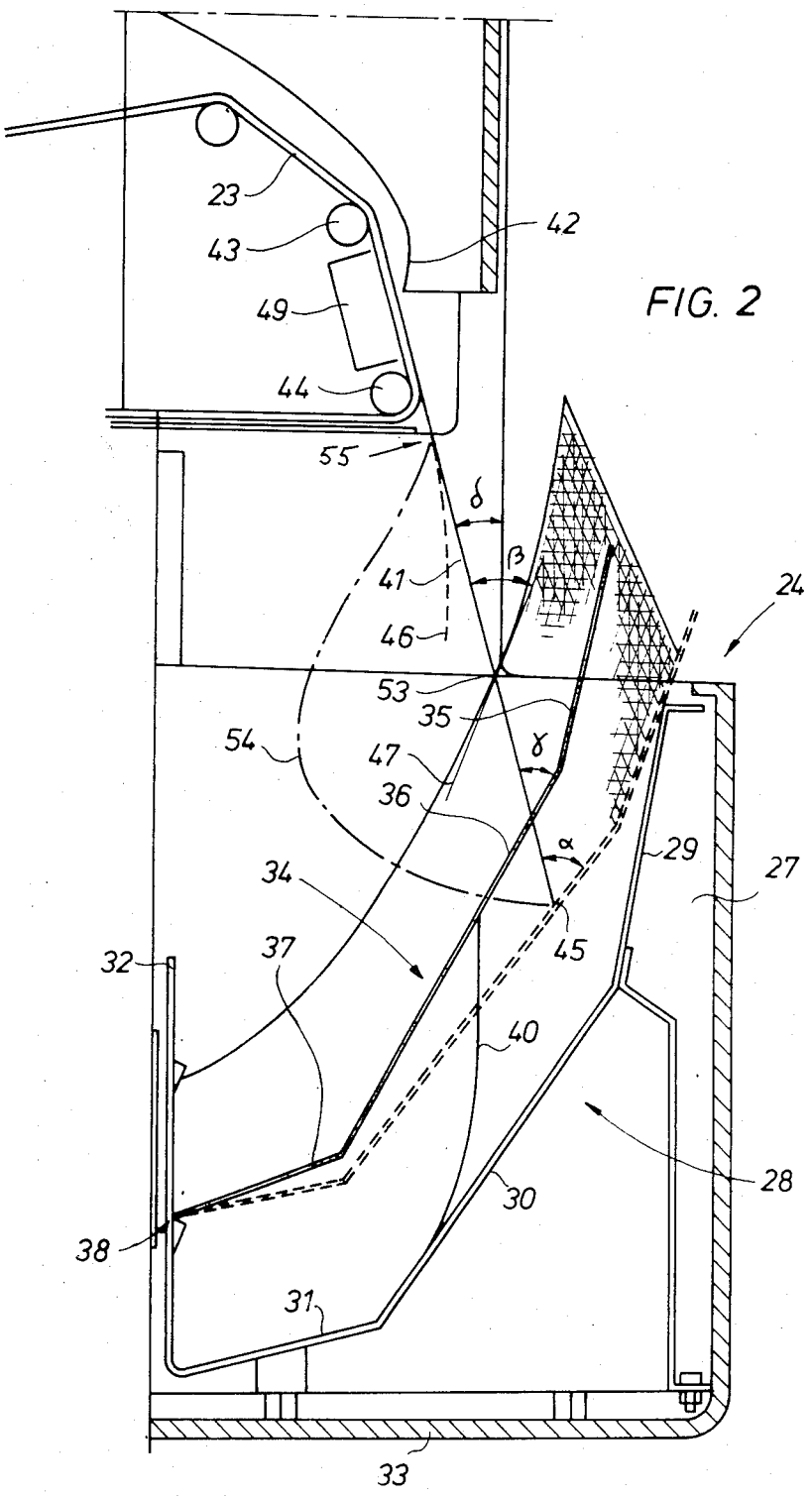
Figure 3:
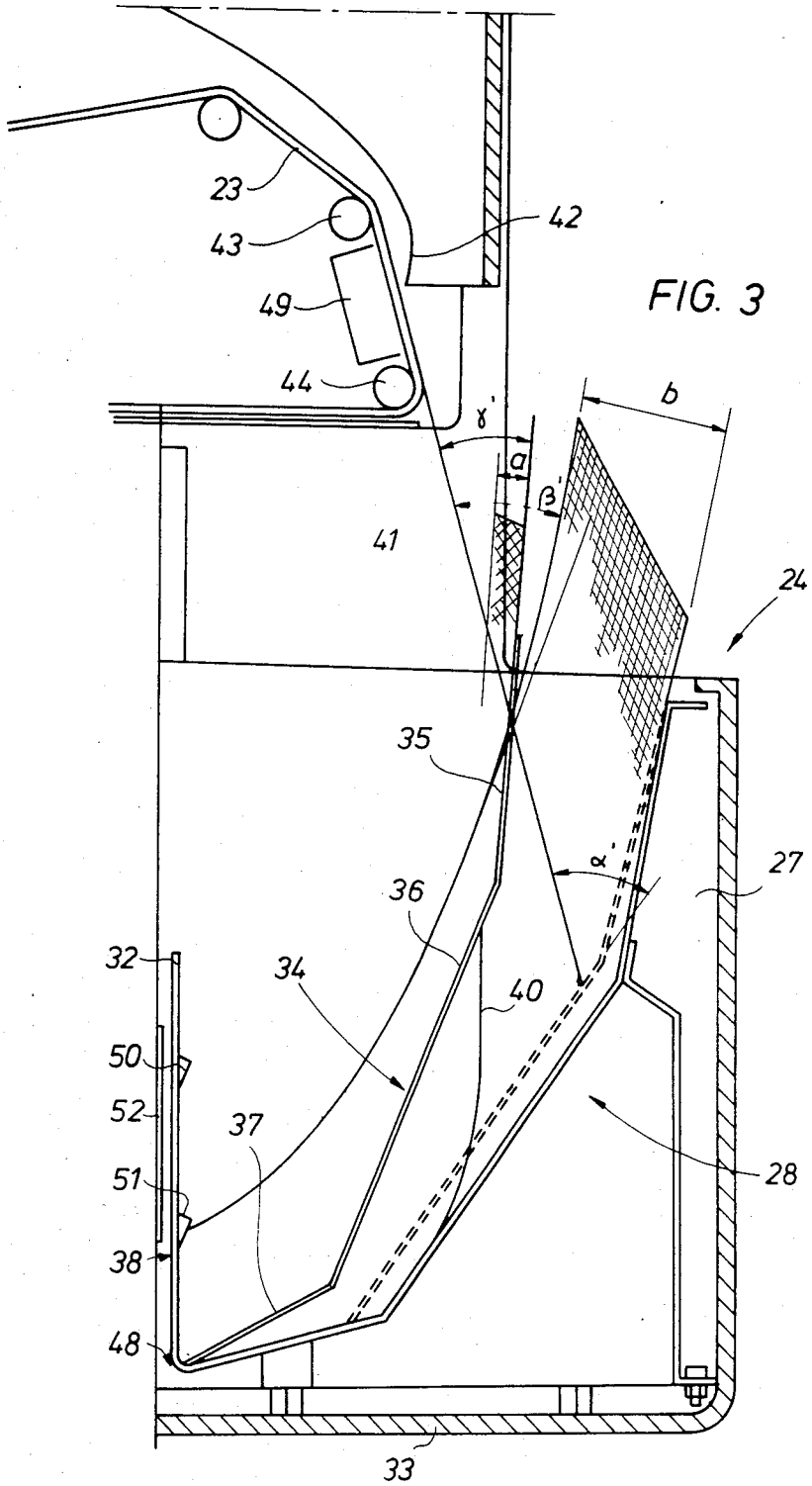

The apparatus according to the invention is described hereinafter by way of example with reference to the accompanying drawings wherein:

FIG. 1 is a diagrammatic view of a conventional electrophotographic printer, FIG. 2 is an enlarged detail view of the collecting tray of the printer of FIG. 1, which is arranged for the receipt of one sheet format, FIG. 3 is an enlarged detail view of the collecting tray of the printer of FIG. 1, which is arranged for the receipt of another sheet format.

FIG. 1 shows an electrophotographic printer designated generally 10. A photoconductor drum 11 is rotated in the direction of the arrow 12 and uniformly electrostatically charged by corona discharge from a charging station 13. The charged drum is image-wise discharged by appropriate line-wise exposure at exposure station 14 that may comprise a number of closely spaced line-wise arranged radiation sources, such as LED's, that are individually energizeable to record the desired image on the drum surface. The dot-wise discharged pattern that remains after the exposure is developed in a developing station 15 containing an appropriate developer with electrostatically charged toner powder that is attracted towards the electrostatic image on the drum. The developed toner mage on the drum 11 is transferred to a plain paper sheet fed from either stack 16 or stack 17 of such sheets. The stack 16 comprises one sheet format or size, and the stack 17 comprises another sheet format. A dispenser roller 18 or 19 removes each time the upper sheet from a stack, and feeds it in timed sequence towards the drum 11 so that the leading sheet edge coincides with the leading edge of the toner image on the drum. A transfer corona 20 causes the transfer of the toner image of the drum to the paper sheet 21. The sheet is then transported towards a fixing station 22 where the toner image is fused into the sheet under the application of heat and pressure. The print is finally removed by a conveyor 23, and received in a collecting tray 24. The photoconductor drum is uniformly flooded with light from a rod-like light source 25, and cleaned at a cleaning station 26, so that it is ready for a next printing cycle. It will be understood that the apparatus comprises many other elements known in the art, such as a toner dispenser control system for the control of the correct toner concentration of the developer station, an electric control system for the control of the sequence of the different mechanic operations, an electronic control system including a character generator, a clock signal generator, shift and latch registers, drivers for the LED's, etc. All these components and sub-units of the apparatus are known in the art and irrelevant for the understanding of the present invention, and therefore are not dealt with any further.

The collector tray 24 of the apparatus is illustrated in detail in FIGS. 2 and 3 which both show the same tray, FIG. 2 showing the tray arranged for the receipt of a smaller sheet format, in this case the DIN A4 format measuring 217×210 mm, and FIG. 3 showing the same tray arranged for receipt of sheets of a larger format, in this case the so-called legal (U.S.) format, measuring 356×216 mm.

Referring to FIG. 2, the collecting tray is mounted in the rear portion 27 of the apparatus 10 and comprises a base plate 28 that has three flat sections 29, 30 and 31, that determine a generally concave profile, and an upstanding end section 32. The base plate may be fixedly attached to the bottom plate 33, as illustrated in the present drawings, but it may also be arranged for reciprocating motion in the transverse direction, in the present case the direction that is normal to the plane of the drawing, in order to align the collected sheets by abutment against a stationary side-wall of the apparatus and also to form part-stacks of sheets. The latter arrangement forms the subject of EU application No. 84 200 453.3 entitled "Sheet imaging apparatus".

A stack supporting back plate generally designated 34 that has three flat sections 35, 36 and 37 is pivotably or rockably attached to the end wall 32 at 38. This pivotal connection can occur in many ways, but a simple and reliable connection is formed by small tongues (not shown) that project from the lower edge of the section 37 of the plate 34 and that are inserted into corresponding horizontally spaced slots (also not shown) in the wall 32. The plates 28 and 34 may be made in any suitable material such as injection-molded or thermo-formed plastic, stainless steel, etc.

The plate 34 is upwardly biased by two transversely spaced leaf springs, only the spring 40 being shown, that are fitted at their lower end to the section 30 of the base plate and that slideably engage with their upper end the rearside of the plate 34.

The upper position of the plate 34 is illustrated in said lines and is taken when there are no sheets in the tray, whereas the lower position of the plate 34 is illustrated in broken lines and is reached when a complete stack of sheets, 500 sheets in the present case, is collected in the tray.

If the sheet supporting plate 34 were immobile, and thus would have the position illustrated in broken lines in order to accomodate a complete stack of sheets, the first delivered sheet would contact the plate at an angle $\alpha$, which is the angle between the section 36 of the back plate (in the broken line position) and the path 41 followed by a sheet delivered from the fixing station. The sheet follows the path 41 at its discharge at point 55 from the fixing station, by the endless conveyor 23, its deflection by the ribs 42, and its pressing against the conveyor at the section between the rollers 43 and 44, as a consequence of the atmospheric pressure acting on the exposed side of the sheet whereas the non-exposed side of the sheet is at a reduced pressure obtained through perforations of the conveyor by a vacuum chamber 49 located behind the conveyor.

The illustrated angle $\alpha$ amounts to about 55 degrees and at this angle it occurs that improperly cut sheets, e.g. sheets that have a slightly frayed leading edge, do not slide downwardly with their leading edge along the back plate 34, but instead thereof they stick with the leading edge on the back plate at point 45 and then double up as shown by the dash and dot line 54, whereby no inversion of the sheet occurs and whereby further stacking is excluded.

On the other hand, the lower position of the back plate 34 is not unsuited for the receipt of a complete stack of sheets, since the angle $\beta$ of incidence between an oncoming sheet and the top sheet of a complete stack of sheets, i.e. the angle between the direction 41 and the tangent 47 to the sheet of the point of incidence 53, amounts to about 40 degrees in the present example. This smaller angle $\beta$, as compared with $\alpha$, is mainly caused by the fanlike upper portion of the stack of sheets, whereby an upper sheet takes a more vertical position than does a lower sheet that rests on the section 35 of the back plate. The lower end of the stack of sheets is more tightly packed because of the more horizontal position of the lower end of the sheet stack and also the abutting of said end against the end plate 32.

If, in accordance with the described embodiment, the back plate 34 is rockable and spring-biased, the plate can take an upper position as shown in solid lines, and in that case the angle of incidence of a sheet is indicated by the angle $\gamma$, in the present case about 45 degrees. It was shown that a variation of the angle of incidence from 45 for an empty tray (the angle $\gamma$) to 40 degrees for a filled tray (the angle $\beta$), did not cause any problem for the satisfactory operation of the apparatus.

It should be understood that the path 41 at which a discharged sheet approaches the collected sheets may undergo deviations. A common deviation is diagrammatically indicated by the path 46 shown in broken lines in FIG. 1 and is due to an excessive heating of the toner image on the sheet whereby the sheet starts to curl in the illustrated direction. A path, such as 46 is not harmful since it has the effect that the angle of incidence of a discharged sheet on the stack of collected sheets decreases.

In the illustrated apparatus, the angle of approach $\delta$ of a delivered sheet (this is the angle between the intended sheet path 41 and a vertical plane) is such that also moderately curling sheets still make contact with the top sheet of the stack of sheets within the upper half of said top sheet.

It will be understood that the satisfactory operation of the collector tray of the apparatus is based on two effects. First, the rockability of the plate 34 at 38 whereby the upper part of the plate is depressed as the size of the stack of collected sheets increases and second, the less dense packing of the sheets near their upper ends than at their lower ends whereby the position of the upper portion of the upper sheet becomes more vertical as the thickness of the stack increases.

FIG. 3 shows the collector tray of FIG. 2, but with the sheet supporting plate 34 pivoted at point 48 instead of at 38 for receiving larger sheets, as mentioned hereinbefore. The position of the plate 34 for an empty tray is illustrated in drawn lines whereas the position of the plate at stack load is shown in broken lines. The leaf springs 40 ensure the biasing of the plate in the same way as they did for the plate in the position of FIG. 2. The angle of incidence of a first delivered sheet in the case of a stationary backing plate at the most remote position of the plate is indicated by $\alpha'$. In the present example said angle amounts to 50 degrees, and it was shown that this angle did not guarantee a troublefree operation.

The angle of incidence of a first delivered sheet in the case of a stationary backing plate at a more elevated position (shown in broken lines) is indicated by $\gamma'$. It is clear that the stack can only attain a limited height, indicated by a, unless the risk becomes too great for an oppositely curved discharged sheet to pass behind the stacked sheets rather than over them.

The rockable arrangement of the sheet supporting back plate operates as described hereinbefore to accomodate relatively large sheet stacks under reliable operating conditions. The thickness of such large stack has been indicated by b.

The collecting tray according to the present example was finally provided with two "full magazine" sensors 50 and 51. These sensors are small tongues made from very flexible leaf steel that project with an angled end portion through a corresponding small opening of the wall 32. As the maximum height of a paper stack on one or the other positions of the plate 34 (at 38 or 48) has been attained, the upper sheet(s) of the stack push(es) either the sensor 50 or 51 outwardly until the sensor contacts with its free edge an electrically insulated plate 52, and so brings about the electric grounding of the plate. The grounding of the plate may produce a warning signal or may cause the arresting of the apparatus.

The apparatus according to the invention is not limited to the described embodiment.

The wall section 32 of the collecting tray can be provided with more than two horizontal rows of slot-like openings so that the back plate 34 may be hingedly connected at different levels to accomodate other sheet formats.

The control of the angular position of the back plate 34 can also be preformed by means other than the springs 40. Said control can occur by counterweight means, or even by rotatable arms or the like that progressively change the angular position of the plate under the control of the number of prints or copies discharged from the apparatus.

The sheet supporting back plate can comprise more sections than the three sections illustrated, and said plate can also have a continuous curvature. Finally, said plate may also be straight although in such case it may occur that higher demands are to be put on the quality of the paper sheets and the treatment of them, to avoid improper stacking as a consequence of curling sheets.

The angle of incidence of a discharged sheet onto the stack of collected sheets may have other values than those mentioned thereinbefore. Suitable limits for said angle are 35 and 45 angular degrees.

The width of the stack-supporting back plate can be large to accomodate stacks of sheets of different widths. The width of said plate can, however, also be smaller and this can be notably interesting in case part-stacks of sheets must be produced in the collector tray by transverse oscillation of the back plate, as disclosed in EU Application No. 84 200 453.3 referred to hereinbefore.

We claim:

1. In a sheet imaging apparatus wherein sheets are taken in succession from a supply stack of such sheets, passed through an imaging station wherein an image is formed on the sheets, then are directed in inverted order along a generally vertical path into a collecting tray which has a sheet supporting back plate that is disposed at an acute angle with respect to the generally vertical path of said sheet, whereby the first contact of the leading end of a discharged sheet with the stack of sheets in the collector tray, or with the sheet supporting plate in the case of the first sheet received in the tray, occurs at an acute angle, and the sheet supporting back plate of said collecting tray is rockably mounted near its lower end and spring biased generally upward so that, as the tray fills with sheets, the back plate sinks down and the size of the acute angle between the sheet path and backplate increases, the improvement comprising an upper part of said back plate disposed at a greater angle with respect to the lower part of the plate so that the sheets received on the plate are flexed upwardly at their upper portion relative to their lower portion, the thickness of the upper stack end increasing over that of the lower stack end with the number of sheets received in the tray as a consequence of the inclusion of air between the sheets, so that the angle of incidence ($\beta,\gamma,\beta',\gamma'$) of a delivered sheet on the stack of collected sheets remains almost constant during the filling of the tray with sheets.

2. Sheet imaging apparatus according to claim 1, wherein the stack supporting back plate has flat sections that define a generally curved profile.

3. Sheet imaging apparatus according to claim 1, wherein said stack supporting back plate is arranged for taking different vertical positions, thereby to accomodate different sheet formats.

4. Sheet imaging apparatus according to claim 1, wherein said apparatus is an electrophotographic printer.

* * * * *